US006390577B1

(12) United States Patent
Fajour

(10) Patent No.: US 6,390,577 B1
(45) Date of Patent: May 21, 2002

(54) FRANKING MACHINE INCORPORATING AN INKJET PRINT HEAD

(75) Inventor: Michel Fajour, Chatillon (FR)

(73) Assignee: Neopost Industrie, Nagneux (FR)

( * ) Notice: Subject to any disclaimer, the term of this patent is extended or adjusted under 35 U.S.C. 154(b) by 1129 days.

(21) Appl. No.: 08/510,491

(22) Filed: Aug. 2, 1995

(30) Foreign Application Priority Data

Aug. 8, 1994 (FR) ..... 94 09 804

(51) Int. Cl.[7] ..... B41J 3/00; B41J 29/38
(52) U.S. Cl. ..... 347/2; 347/12
(58) Field of Search ..... 347/2, 19, 4, 23, 347/36, 35, 89, 90, 12, 14, 33

(56) References Cited

U.S. PATENT DOCUMENTS 3,925,789 A * 12/1975 Kashio ..... 347/35
4,485,368 A * 11/1984 Dagna et al. ..... 347/12
5,051,761 A * 9/1991 Fisher et al. ..... 347/33
5,189,442 A * 2/1993 Herbert ..... 347/2
5,455,615 A * 10/1995 Burr et al. ..... 347/92
5,617,122 A * 4/1997 Numata et al. ..... 347/14

FOREIGN PATENT DOCUMENTS

EP 0416849 A2 3/1991
EP 0451827 A2 10/1991
EP 0589581 A2 3/1994
EP 595657 * 5/1994 ..... B41J/2/21
JP 63-252748 * 10/1988 ..... 347/23

* cited by examiner

*Primary Examiner*—Thinh Nguyen
(74) *Attorney, Agent, or Firm*—Sughrue Mion, PLLC

(57) ABSTRACT

A franking machine includes an inkjet print head including a row of nozzles operated selectively to print a postal mark on a mail item passing under the print head. Only consecutive first nozzles of the row of nozzles forming a subset of the set of available nozzles in the row are operated to print the postal mark. Other nozzles of the row of nozzles, different than the first nozzles, are operated when there is no mail item in front of the print head in order to purge the other nozzles in order to prevent them becoming clogged in time.

5 Claims, 3 Drawing Sheets

FRANKING MACHINE INCORPORATING AN INKJET PRINT HEAD

BACKGROUND OF THE INVENTION

1. Field of the Invention

The invention relates generally to franking machines which are now widely, used in corporate mailrooms.

It relates more particularly to a franking machine incorporating an inkjet print head.

2. Description of the Prior Art

The inkjet printing technology is already widely used in the field of document printing and is increasingly taking over from laser printing. Inkjet printing technology is only beginning to penetrate the field of franking machines as a substitute for conventional printing using print wheels.

A constant concern of franking machine manufacturers is to offer the public franking machines at the lowest possible cost. The aim of reducing costs makes it desirable to incorporate into these machines, to the greatest possible degree, off the shelf components that are already widely used and proven in service. This applies to the print head of a franking machine using the inkjet technology.

An inkjet print head of a franking machine includes a large number of mechanical or electronic components in addition to the print cartridge which carries out the inkjet printing. This cartridge is usually in the form of a small box in which a plurality of nozzles are mounted in a row. These nozzles are fed with ink by a micropump which draws the ink from an ink reservoir. They are controlled by an electronic circuit which excites them individually to cause them to eject droplets of ink.

Inkjet print cartridges of this kind are available off the shelf for use in printers to be connected to a microcomputer. The range of such cartridges available is extremely varied. There are cartridges with 64 nozzles, 128 nozzles, and so on. The number of nozzles in the cartridge usually determines one dimension of the pattern that the latter can print. Taking a cartridge with 256 nozzles, for example, with the nozzles spaced by 1/200 inch, this dimension of the pattern that can be printed by the cartridge is therefore 32.5 mm. In the case of a cartridge with 128 nozzles, this dimension of the pattern that can be printed is 16.25 mm for the same pixel density.

The postal marks to be printed on mail items by a franking machine must have a stamp height of 30 mm, for example. This dimension is imposed by the postal authorities. It may vary from one country to another. To print these postal marks it is possible to use a plurality of print cartridges having 128 nozzles or 64 nozzles or a single cartridge with 256 nozzles. In both cases, the inkjet print cartridge(s) is (or are) mounted in a franking machine so that the row of nozzles is substantially perpendicular to the direction in which mail items to be franked pass under the print head of the machine.

The use of a plurality of inkjet print cartridges complicates control of the nozzles. It is easier to use an inkjet print head with a row of 256 nozzles. In this case, it is clear that some of the nozzles (16 of the nozzles in the row) do not need to be excited to print any postal mark because the latter's 30 mm dimension is less than the length of the row of nozzles.

Each nozzle of an inkjet print cartridge is in the form of two partitions made from a piezoelectric material, for example. To eject a droplet of ink from the nozzle the piezoelectric walls of the nozzle are deformed by applying an electric voltage to them. If the 256 nozzles of a cartridge of this kind are numbered from B0 through B255, the cartridge comprises 257 piezoelectric partitions numbered from 0 through 256. Since 16 nozzles do not need to be excited, partitions 240 through 256 are not normally excited by the electrical voltage. As a result the ink inside nozzles B240 through B255 is never ejected. If any nozzle is not excited for some time, the ink inside it tends to dry, which clogs the nozzle, and the dried ink in the nozzle is likely to block any movement of the piezoelectric walls of the nozzle in question. This phenomenon of immobilization of the piezoelectric walls of a nozzle propagates from nozzle to nozzle and eventually leads to general dysfunctioning of the print cartridge.

An object of the invention is to remedy this drawback.

SUMMARY OF THE INVENTION

To this end, the invention consists in a franking machine including an inkjet print head including a row of nozzles operated selectively under the control of control means to print a postal mark on a mail item passing under the print head and in which only consecutive first nozzles of the row of nozzles forming a subset of the set of available nozzles in the row are operated by the control means to print the postal mark, wherein the control means are further adapted to operate other nozzles of the row of nozzles, different than said first nozzles, when there is no mail item in front of the print head in order to purge said other nozzles in order to prevent them becoming clogged in time.

If the first nozzles are the nozzles numbered B0 through B239, the control means prevent the ink remaining in nozzles B240 through B255 drying out and preventing operation of those nozzles and, by virtue of the knock-on effect, the operation of other nozzles.

An ink recovery reservoir is provided in the machine, under the row of nozzles, to collect the ink ejected by nozzles B240 through B255.

The control means is adapted to excite nozzles B240 through B255 is a cyclic fashion, as often as necessary to prevent them clogging, a procedure which is easy to program.

Nozzles B240 through B255 are preferably excited in the time interval available between the passage of one mail item in front of the print head and the passage of a subsequent mail item in front of the print head. This time interval is more than sufficient to carry out this operation, which does not disturb the normal franking of mail items and does not affect the throughput of the machine.

In one embodiment of the invention the control means are adapted to operate different subsets of first nozzles alternately, those subsets occupying offset positions within the set of nozzles available in the row of nozzles in order to excite all the nozzles in the row of nozzles over a period of time.

This achieves substantially the same result as previously without requiring any ink recovery reservoir. This procedure also distributes wear of the print head substantially uniformly over all the nozzles.

In both embodiments a counter for each nozzle counts the number of times the nozzle is excited in order to produce a warning message or to inhibit operation of the franking machine if any of the counters exceeds a threshold value representing a level of wear of the corresponding nozzle. It is to be understood that these counters can be implemented in software or by any equivalent means. This procedure enhances the reliability of the franking machine by preventing the risk of incomplete printing of a postal mark.

Further features and advantages of the invention will emerge from the following description of embodiments of the invention given with reference to the drawings.

DETAILED DESCRIPTION OF THE PREFERRED EMBODIMENTS

Figure 1:
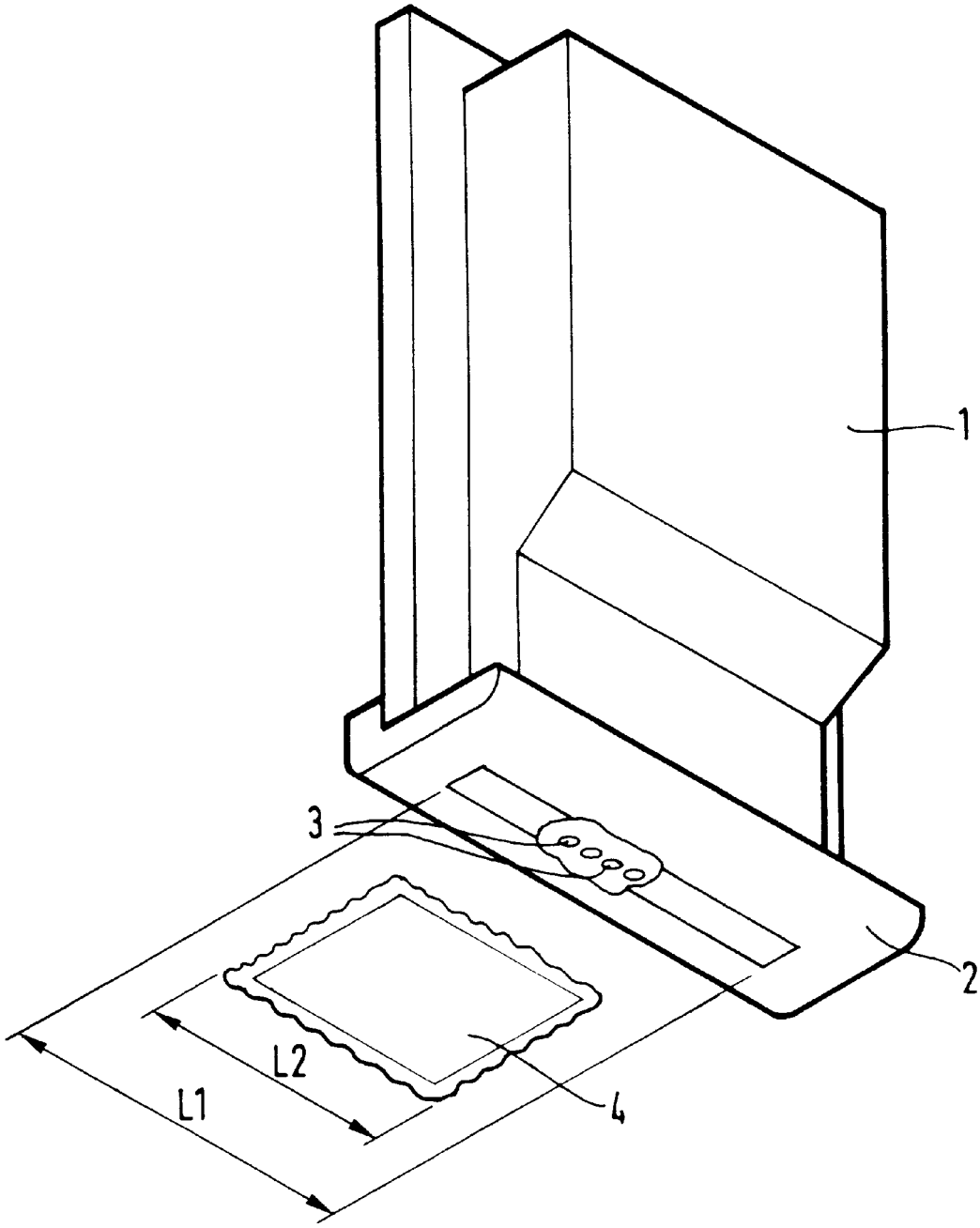
FIG. 1 is a perspective view of an inkjet print cartridge incorporating a row of nozzles.

FIG. 1 shows a conventional inkjet print cartridge 1. It is in the form of a small box extended by a manifold 2 incorporating a row of nozzles 3. In this example the manifold comprises 256 aligned nozzles over a distance of approximately 32.5 mm, the gap between two adjacent nozzles being 1/200 inch. The cartridge is adapted to be mounted in a print head of a franking machine to print a postal mark 4. The postal mark has a dimension L2 of 30 mm which is shorter than the length L1 of the row of nozzles 3 in the manifold 2. Evidently, only some of the nozzles 3 are needed to print a postal mark.

Figure 2:
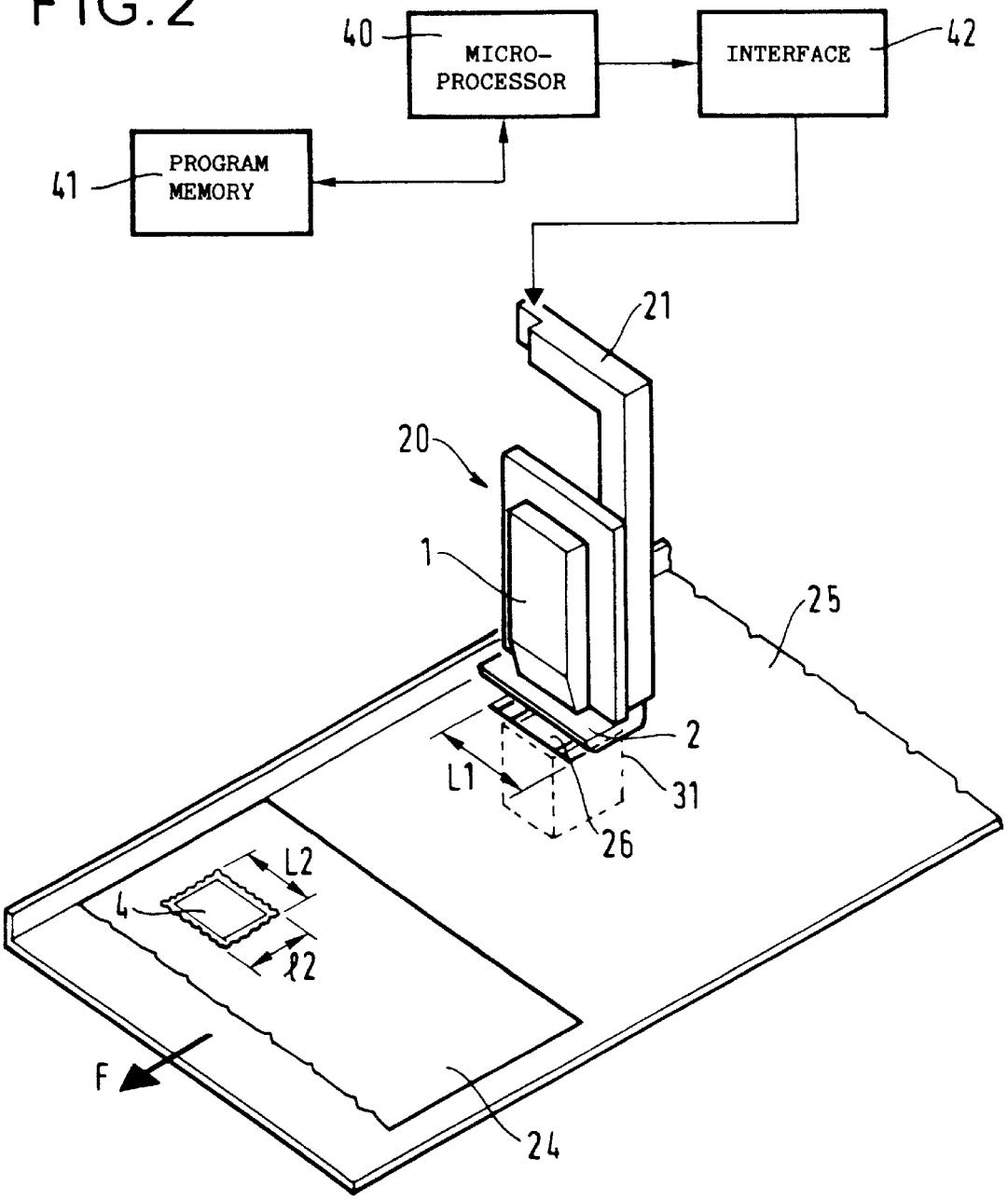
FIG. 2 is a diagram showing part of a franking machine having an inkjet print head.

FIG. 2 shows the franking machine with an inkjet print head together with the print cartridge 1 which is part of the print head 20. It is fixed to a support 21, such as a boom, so as to overlie a guide plate 25 across which mail items 24 move in sequence in the direction of the arrow F so that one side of each item passes under the manifold 2 of nozzles.

The mail items are moved across the plate 25 by rollers, belts and pressure rollers (not shown) that are conventional in themselves and form part of the franking machine.

The print cartridge 1 is controlled by the electronics of the franking machine. These electronics conventionally comprise a microprocessor 40, a program memory 41 and an interface 42. The interface 42 is a register that can be addressed by the microprocessor and which has a capacity of 32 bytes into which the microprocessor loads temporarily 256 respective control bits for the 256 nozzles of the print cartridge 1. By convention, a control bit at 1 causes excitation of the corresponding nozzle whereas a bit at 0 prevents excitation of that nozzle. When a nozzle is excited it ejects a droplet of ink.

When the 256 control bits are loaded into the interface 42 and a mail item is under the row of nozzles, the electrical signals are sent to the piezoelectric walls of a print cartridge 1 in order selectively to excite the walls of the 256 nozzles of the print cartridge 1.

The postal mark printed by the nozzles on the mail item can be of various kinds and, to simplify, fit within a rectangle having a width L2 of 30 mm and a length 12 of about 60 mm. The length L1 of the row of nozzles in the manifold 2 is thus greater than the width L2 of a mark, as mentioned above.

The nozzle control bits are managed by a control program stored in the memory 41. This program which controls the microprocessor 40 is adapted to load 256 control bits into the interface 42 in each print cycle, a franking cycle obviously comprising a large number of print cycles.

In normal use of the print cartridge only 240 nozzles are actually used. In other words, only 240 nozzles from the row of 256 nozzles need to be excited to print a postal mark because of the respective dimensions of the postal mark and the row of nozzles. The other nozzles of the row, namely 16 nozzles, are never excited and this leads to them becoming clogged.

To prevent this these 16 nozzles are operated cyclically in order to purge them. To this end, the support plate 25 has an opening 26 opposite the row of nozzles and in particular opposite the 16 nozzles in question and a reservoir 31 is placed inside the opening 26 to collect the ink ejected by these 16 nozzles when they are excited to purge them.

Figure 3:
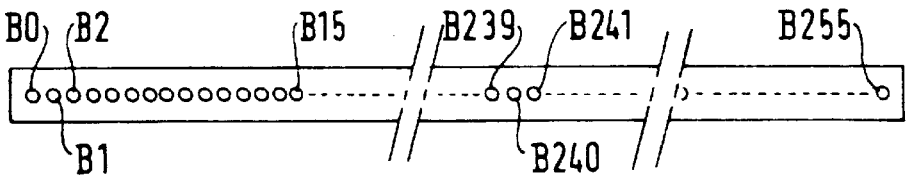
FIG. 3 shows the organization of the nozzles in the print head.

FIG. 3 shows the row of nozzles, which are numbered from B0 through B255. In the embodiment of the invention described above, nozzles B0 through B239 are those used by the program to print a postal mark. Nozzles B240 through B255 are those which are not normally excited during a franking cycle. As the nozzles that are not normally excited to print a postal mark are at one end of the nozzle manifold, a small and therefore compact reservoir 31 is sufficient to collect the ink purged from those nozzles.

The set of nozzles used to print a postal mark could equally well be the nozzles B1 through B240 or B2 through B241 or any other set of 240 consecutive nozzles of the set of nozzles available in the row of nozzles. In each case a reservoir 31 must be provided having dimensions such that it is able to collect the ink ejected by the nozzles that are normally not excited to print a postal mark.

The nozzles that are not normally excited during printing of a postal mark are purged cyclically, preferably after each franking cycle when no mail item is present in front of the print head. To avoid any impact on the franking throughput, the control program is adapted to command excitation of nozzles B240 through B255 (for example) to purge them in the time interval between the passage of one mail item in front of the print head and the passage of the next mail item in front of the print head, which time is readily determined by means of optical sensors which detect the presence or the absence of a mail item in front of the opening 26.

The nozzles can of course be purged less frequently, for example every ten franking cycles or each time the franking machine is switched on, provided that the frequency of purging is sufficient to prevent clogging of the nozzles.

Figure 4:
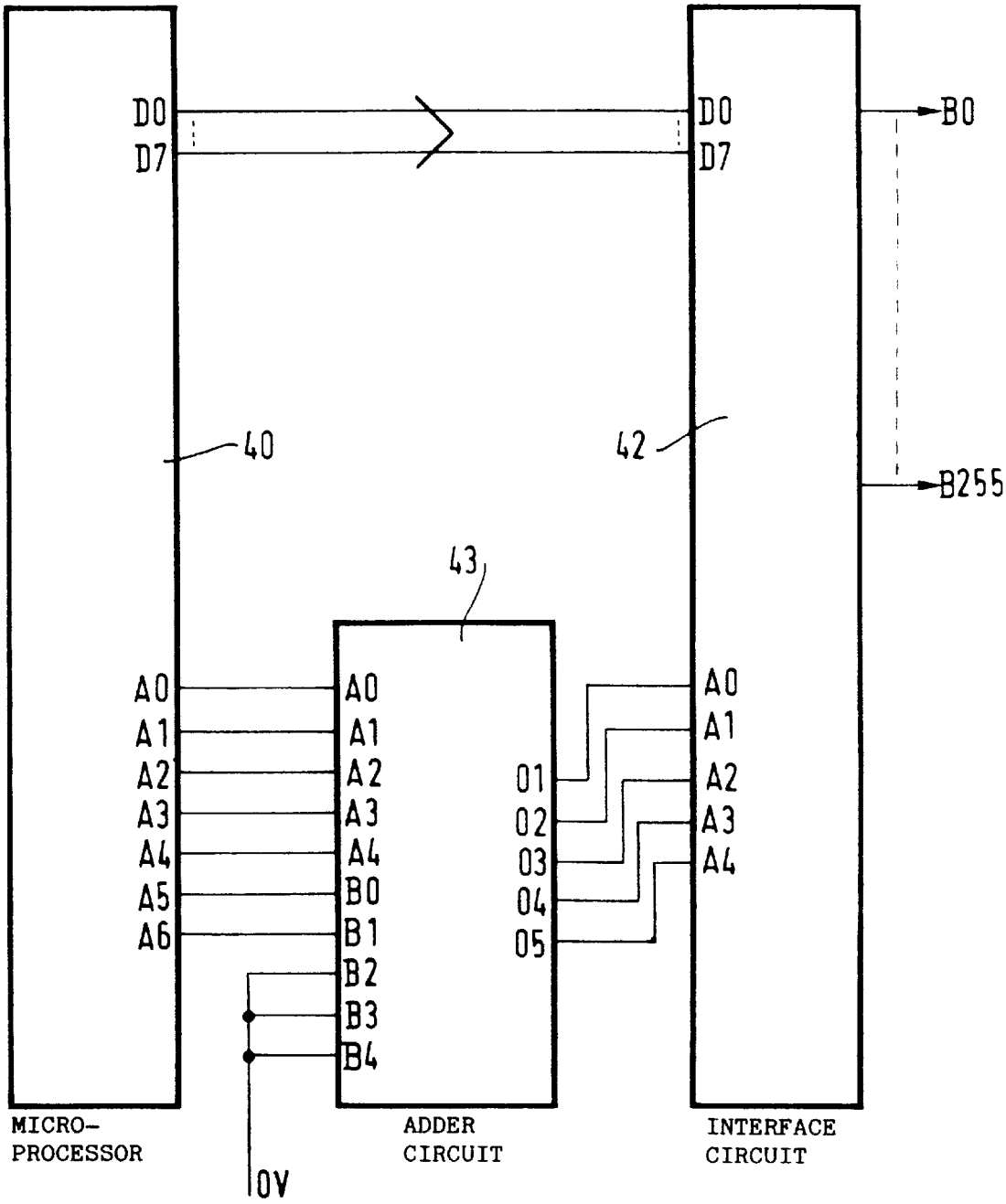
FIG. 4 shows a second embodiment of the invention.

The other embodiment of the invention is described with reference to FIG. 4 which shows in more detail the microprocessor 40 connected to the interface circuit 42 by a data bus D0–D7.

The five address outputs A0–A4 of the microprocessor are connected by an address bus to the five address inputs A0–A4 of the interface circuit in which they select one of the 32 bytes which together form the 256 control bits for the nozzles B0 through B255. The 32 bytes made up of control bits are loaded sequentially into the interface circuit by the control program via the data bus and in accordance with addresses on the address bus.

As already mentioned, only 240 nozzles are actually used to print a postal mark, for example nozzles B0 through B239. Consequently, the control program manages only the first 30 control bytes (called the "active" bytes) to print a postal mark. These 30 control bytes define a subset of nozzles of the set of nozzles available in the row of nozzles dedicated to printing a postal mark. The bits of the last two control bytes are forced to 0 to prevent excitation of the corresponding nozzles B240 through B255.

To prevent clogging of the nozzles B240 through B255 the control program is such that the 30 active bytes for printing a postal mark are not always the same first 30 bytes of the 32 bytes in the interface circuit.

Control of the active bytes corresponds to control of different subsets of active nozzles, these subsets occupying offset positions within the set of nozzles available in the row of nozzles.

This offset corresponds to different addressing configurations of active nozzles in the row of nozzles by the microprocessor, these configurations being easy to generate by means of software.

An offset with a step of 1 is explained below with reference to FIG. 3.

In a first franking cycle the control program holds the control bits for nozzles B240 through B255 at 0. A postal mark is therefore printed on a first mail item by selected nozzles from the combination of nozzles B0 through B239 only.

In the next franking cycle the control program holds the control bits of nozzles B0 and B241 through B255 at 0. During this franking cycle only selected nozzles from nozzles B1 through B240 contribute to printing of the postal mark. As a result the latter is offset one point in a direction perpendicular to the direction F relative to the postal mark printed on the previous item.

In the next franking cycle the control program holds the control bits of nozzles B0, B1 and B242 through B255 at 0. Only selected nozzles from nozzles B2 through B241 are excited to print a postal mark.

The offset is repeated on each franking cycle up to the franking cycle in which selected nozzles from nozzles B15 through B256 are excited. It then resumes with selected nozzles from nozzles B0 through B239 (see above).

Of course, the offset could be applied every two or more franking cycles and with a step size different than 1.

The offset can advantageously be implemented by means of an adder circuit with an offset step corresponding to a control byte. In FIG. 4, an adder 43 is inserted between the address outputs A0–A4 of the microprocessor and the address inputs A0–A4 of the interface circuit. The adder has two series of address inputs A0–A4 and B0–B4 and one series of address outputs O1–O5 corresponding to an addition of the address inputs. The address inputs A0–A4 of the adder circuit are connected to the address outputs A0–A4 of the microprocessor. The address outputs O1–O5 of the adder circuit are connected to the address inputs A0–A4 of the interface circuit. The address inputs B0–B1 of the adder circuit are connected to the address outputs A5–A6 of the microprocessor and the address inputs B2–B4 of the adder circuit are held at 0. The inputs B0–B1 of the adder supply the offset value (number of bytes) to be applied to the byte addresses supplied by the inputs A0–A4 of the adder.

The system operates as follows: in each print cycle the control program supplies the first 30 active control bytes to print a postal mark and two bytes in which the bits are forced to 0. This configuration of the 32 bytes generated by the control program remains exactly the same during successive print cycles and franking cycles.

However, different values of byte address offset (0, 1 or 2) are applied alternately to the address inputs B0–B1 of the adder in each franking cycle.

In the first franking cycle, if the value of the offset applied to the address inputs B0–B1 is 0, the first 30 bytes in the interface circuit receive the 30 active bytes generated by the control program. Only nozzles B0 through B239 can be excited. The subset of nozzles used to print a postal mark occupy a first position in the set of nozzles available in the row of nozzles.

In the next franking cycle the offset value 1 is applied to the inputs B0–B1 of the adder and bytes 2 and 31 receive the first 30 active bytes generated by the control program. Only nozzles B8–B247 can be excited. In this addressing configuration of the active bytes, the subset of nozzles used to print a postal mark occupies a second position which is offset within the set of nozzles available in the row of nozzles relative to the position occupied by the subset of nozzles used in the previous franking cycle.

In the next franking cycle the offset value 2 is applied to the inputs B0–B1 of the adder and bytes 3 and 32 receive the first 30 active bytes generated by the control program. Only nozzles B16–B255 can be excited. In this addressing configuration of the active bytes, the subset of nozzles used to print a postal mark occupies a third position which is offset within the set of nozzles available within the row of nozzles relative to the position occupied by the subset of nozzles used in the previous franking cycle.

Control of the nozzles continues by returning to the configuration used for the first franking cycle.

These byte address offsets cause all the nozzles in the row of nozzles to be operated during successive franking cycles which avoids the problem of some nozzles becoming clogged. One result of this offset is distribution of wear of the print cartridge over all its nozzles.

To enhance the reliability of the inkjet print head franking machine, the control program is advantageously adapted to count the number of times each nozzle is excited in respective counters associated with the nozzles in the row of nozzles on the print cartridge 1, and to command the output of a visual or audible message to warn the franking machine user if any of the counters exceeds a threshold value and/or to inhibit operation of the franking machine in this situation. The threshold value corresponds to an average level of wear of the print cartridge. In this way it is possible to prevent incomplete printing of a postal mark on a mail item due to wear of one or more nozzles on the print cartridge.

What is claimed is:

1. A franking machine comprising:

an inkjet print head including a row of nozzles; and a controller for selectively operating said print head to print a postal mark on a mail item passing under said print head, wherein sets of said nozzles, each of which including a plurality of nozzles disposed consecutively in the row, are operated by the controller to print the postal mark on a plurality of mail items, said sets each having a number of nozzles less than a total number of said nozzles in the row and being offset from each other so as to include some of said nozzles of other of said sets, and wherein said controller alternatively operates different ones of said sets of said nozzles so as in time to operate all of said nozzles of said row of nozzles.

2. The machine according to claim 1, wherein said machine performs a plurality of franking cycles to print said postal mark on said plurality of mail items, and wherein said controller operates a different one of said sets of nozzles in each of said franking cycles.

3. The machine according to claim 2, including an address adder circuit which alternates operation of said subsets of first nozzles.

4. The machine according to claim 1, wherein said controller counts a number of times that said nozzle is generated in order to produce a warning message or said if said number exceeds a threshold value.

5. The machine according to claim 1, wherein said controller counts a number of times that said nozzle is generated in order to inhibit operation of said franking machine if said number exceeds a threshold value.

* * * * *